US010792938B2

(12) United States Patent
Tsukuda et al.

(10) Patent No.: US 10,792,938 B2
(45) Date of Patent: Oct. 6, 2020

(54) PRINTING APPARATUS

(71) Applicant: CANON KABUSHIKI KAISHA, Tokyo (JP)

(72) Inventors: Masakazu Tsukuda, Yokohama (JP); Seiji Ogasawara, Machida (JP); Takaaki Ishida, Kawasaki (JP); Shuichi Tokuda, Kawasaki (JP); Masaaki Matsuura, Kawasaki (JP); Kazuki Matsuo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/223,729

(22) Filed: Dec. 18, 2018

(65) Prior Publication Data

US 2019/0193427 A1 Jun. 27, 2019

(30) Foreign Application Priority Data

Dec. 27, 2017 (JP) ..... 2017-251727

(51) Int. Cl.
*B41J 11/00* (2006.01)
*B41J 11/48* (2006.01)

(52) U.S. Cl.
CPC ..... *B41J 11/007* (2013.01); *B41J 11/485* (2013.01)

(58) Field of Classification Search
CPC ..... B41J 11/007; B41J 11/485
See application file for complete search history.

(56) References Cited

U.S. PATENT DOCUMENTS 4,709,915 A 12/1987 Ishikawa et al.
5,899,613 A 5/1999 Koike et al.
6,273,414 B1 8/2001 Matsuo
2004/0130089 A1* 7/2004 Suzuki ..... B65H 3/44 271/9.01

FOREIGN PATENT DOCUMENTS

JP 2013-237496 A 11/2013

OTHER PUBLICATIONS

Computer-generated translation of JP 2013-237496, published on Nov. 2013 (Year: 2013).*

* cited by examiner

*Primary Examiner* — Huan H Tran
(74) *Attorney, Agent, or Firm* — Venable LLP

(57) ABSTRACT

A printing apparatus includes a first feeding part configured to feed print media from a first support part supporting the print media, a second feeding part configured to feed print media from a second support part supporting the print media, and a print head configured to print on the print media fed by the first feeding part or the second feeding part. Further, the printing apparatus includes a first conveying path where the print media fed by the first feeding part are conveyed to the print head, and a second conveying path where the print media fed by the second feeding part are conveyed to the print head. At least a part of the second feeding part protrudes in a predetermined spatial area within the first conveying path during a feed operation of feeding print media from the second support part.

13 Claims, 16 Drawing Sheets

PRINTING APPARATUS

BACKGROUND OF THE INVENTION

Field of the Invention

The present invention relates to a printing apparatus including a print head configured to perform printing on a print medium supplied to a print area and a print media feeding unit configured to feed the print media to the print area, and a print media feeding apparatus.

Description of the Related Art

There is known a printing apparatus that includes, at a plurality of locations, feeding parts configured to feed sheet-shaped print media one by one to a printing device. For example, Japanese Patent Laid-Open No. 2013-237496 discloses a printing apparatus such as that illustrated in FIG. 16. The printing apparatus has provided therein a plurality of internal feeding parts (first feeding parts 500) and an external feeding part (second feeding part 600) protruding out of the apparatus, the plurality of feeding parts 500 and 600 selectively operate according to user instructions. Print media fed from the feeding parts 500 and 600 are conveyed along a conveying path provided in a manner corresponding to each feeding part, and supplied to a printing device 700.

In a conventional printing apparatus including a plurality of feeding parts, respective feeding parts are connected to different conveying paths, and a spatial area within each conveying path is used as a spatial area dedicated to convey the print media. In other words, a plurality of feeding parts are provided at a position that allows avoidance of interference with a conveying path other than the corresponding conveying path. Similarly in the printing apparatus disclosed in Japanese Patent Laid-Open No. 2013-237496, the feeding part 500 connected to a conveying path 501 is provided at a position separated from a conveying path 601 connected to the other feeding part 600, whereby interference between an operation member of the feeding part 500 and the other feed conveying path 601 may be avoided. However, the conventional device is required to provide a dedicated spatial area for each feeding part and each conveying path, which is a factor that prevents downsizing of the apparatus.

It is an object of the present invention to provide a printing apparatus that may be configured small in size, without obstructing conveyance of print media along the conveying path.

SUMMARY OF THE INVENTION

The present invention is a printing apparatus comprising: a first feeding part configured to feed print media from a first support part supporting the print media; a second feeding part configured to feed print media from a second support part supporting the print media, a print head configured to print the print media fed by the first feeding part or the second feeding part; a first conveying path where the print media fed by the first feeding part are conveyed to the print head; and a second conveying path where the print media fed by the second feeding part are conveyed to the print head, wherein at least a part of the second feeding part protrudes in a predetermined spatial area within the first conveying path during a feed operation of feeding print media from the second support part.

According to the present invention, it becomes possible to provide a printing apparatus that may be configured small in size, without obstructing conveyance of print media along the conveying path.

Further features of the present invention will become apparent from the following description of exemplary embodiments with reference to the attached drawings.

DESCRIPTION OF THE EMBODIMENTS

Figure 1:
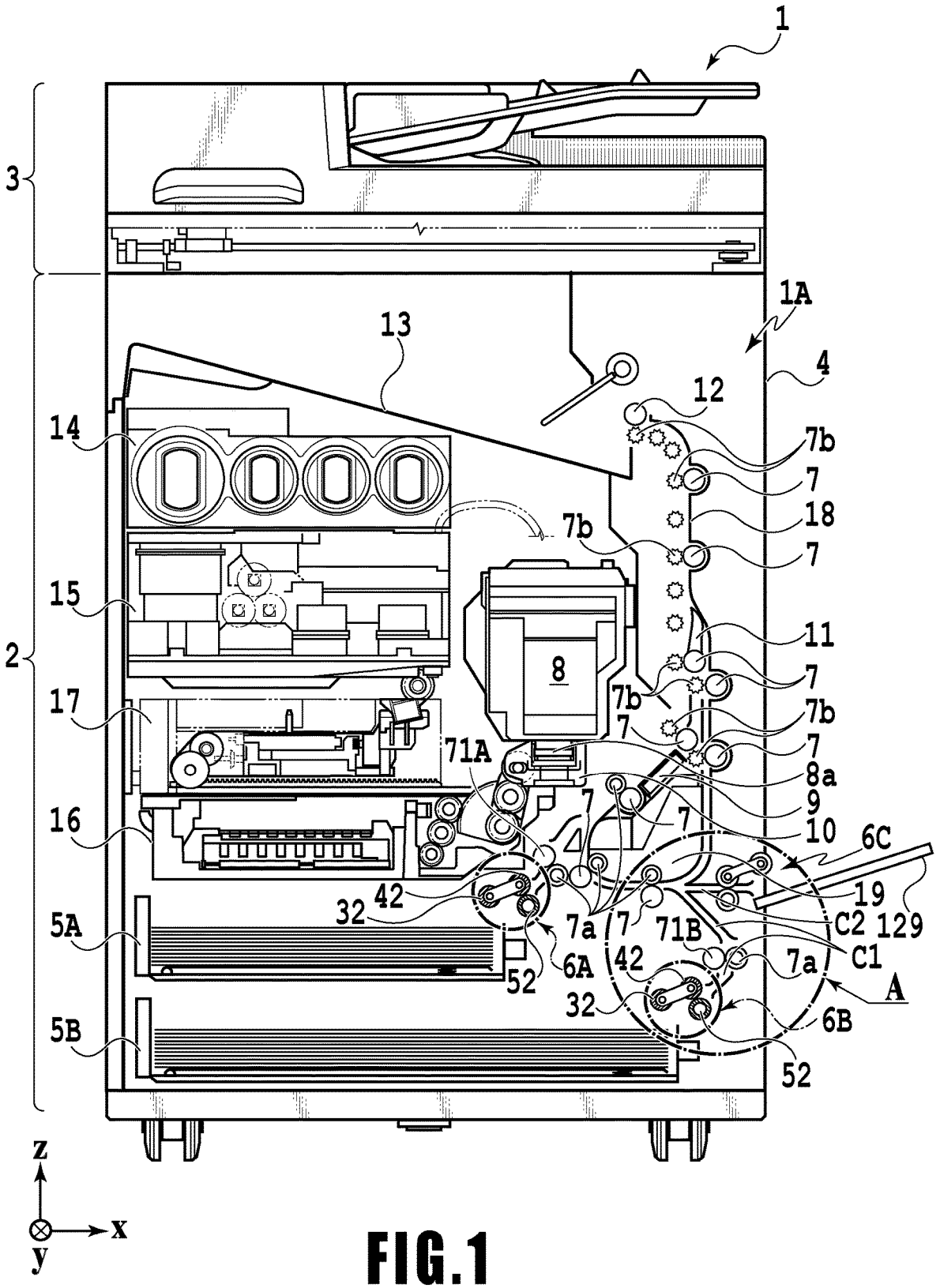
FIG. 1 is a front view of a printing apparatus being in a stand-by state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted.

FIG. 1 shows the printing apparatus 1 in a standby state in which neither print operation nor scan operation is performed.

In a print unit 2, a first cassette 5A and a second cassette 5B (first support parts) capable of stacking print media (cut sheets) S are detachably provided at the bottom of a casing 4 in the vertical direction. The first cassette 5A stores relatively small print media S up to A4 size and the second cassette 5B stores relatively large print media S up to A3 size, respectively housed in a stacked state. In the vicinity of each cassette, a cassette feeding unit (first feeding part) is provided for feeding, separately one by one, the print media S stacked on the cassette. In the following description, the cassette feeding unit for feeding the print media S from the first cassette 5A will be referred to as a first feeding unit 6A, and the cassette feeding unit for feeding the print media S from the second cassette 5B will be referred to as a second feeding unit 6B.

At the side of the casing 4 in the print unit 2, there is provided a manual feeding tray (second support part) 129 for use by the user in the case of feeding a relatively small number of sheets of the print media S. The manual feeding tray 129 may have stacked thereon not only the print media S of a fixed form as with the aforementioned cassette, but also the print media S of an indeterminate size. Stacking the print media S on a predetermined position of the manual feeding tray 129 may cause a manual feeding unit 6C (second feeding part) to operate and feed the print media S to a conveying path described below. The print unit 2 selectively operates a single feeding unit out of the first feeding unit 6A, the second feeding unit 6B, and the manual feeding unit 6C, and supplies the print media S one by one to a print area (receiving part) P between a print head 8 and a platen 9.

Conveying rollers 7, a first intermediate roller 71, a discharging roller 12, pinch rollers 7*a*, spurs 7*b*, a guide 18, an inner guide 19, and a flapper 11 are conveying mechanisms (conveying devices) for conveying the print medium S in a predetermined direction. The conveying rollers 7 are drive rollers provided upstream and downstream of the print head 8 (platen 9) and driven by a conveying motor. The pinch rollers 7*a* are follower rollers (driven rollers) rotating together with the conveying rollers 7 while nipping the print medium S. The discharging roller 12 is a drive roller provided downstream of the conveying rollers 7 and driven by a discharging motor. The spurs 7*b* nips and conveys the print medium S, together with the conveying rollers 7 and the discharging roller 12 provided downstream of the print head 8 (platen 9).

The printing apparatus 1 has provided thereon a plurality of motors for driving the drive rollers, each of the drive rollers being connected to one of the plurality of motors. The correspondence relation between the motors and the drive rollers will be described in detail below.

The guide 18, which is provided on the conveying path of the print medium S, guides the print medium S in a predetermined direction. The inner guide 19, which is a member extending in the y-direction and having a curved side surface, guides the print medium S in a manner conforming to the side surface. The flapper 11 is a member for switching the direction in which the print medium S is conveyed depending on whether the printing is a simplex print operation of printing on one side of the print medium S, or a duplex print operation. The discharging tray 13 is a tray for stacking and holding the print medium S discharged by the discharging roller 12, upon completion of a print operation.

The print head 8 of the present embodiment is a full line type color inkjet print head, having a plurality of ejection openings configured to eject ink according to print data arranged in the y-direction illustrated in FIG. 1, as many as required to cover the applicable maximum width of the print medium S. In the case where the print head 8 is at a stand-by position, an ejection opening surface 8*a* of the print head 8 is oriented vertically downward and capped by a cap unit 10, as illustrated in FIG. 1. In the case of performing printing, the direction of the print head 8 is changed by a print controller 202 described below so that the ejection opening surface 8*a* faces the platen 9. The platen 9 includes a flat plate extending in the y-direction, and supports a side (back side) opposite to the front side (first side) of the print medium S on which print operation is to be performed by the print head 8. Movement from a stand-by position to a printing position of the print head 8 will be described in detail below.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
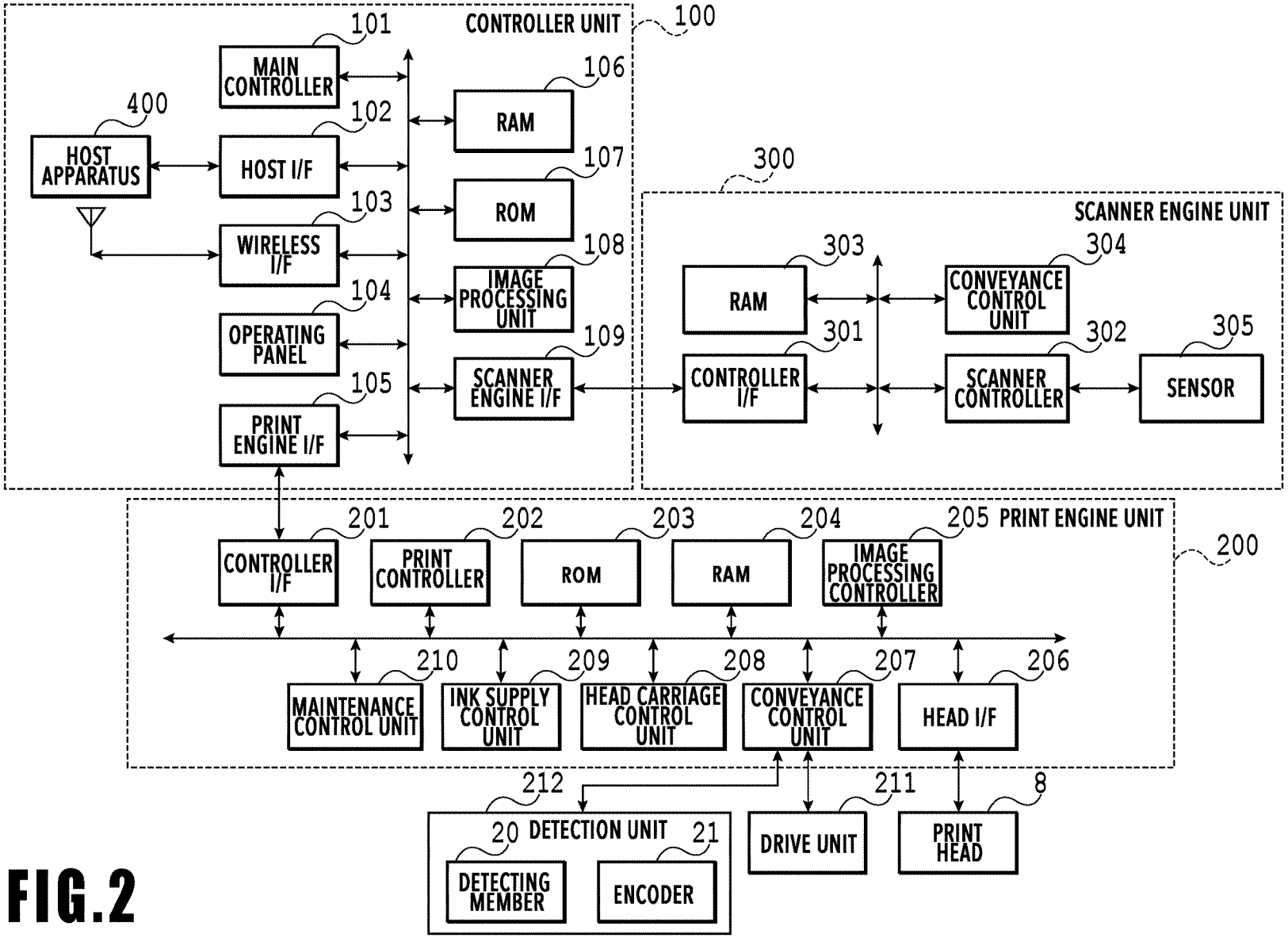
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform an operation such as copying or scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various programs and parameters stored in a ROM 203. Upon receiving various commands and image data via a controller I/F 201, the print controller 202 temporarily stores the commands and the image data in the RAM 204. The print controller 202 causes an image processing controller 205 to convert the stored image data into print data to allow the print head 8 to perform a print operation (ink ejection operation). Upon generating the print data, the print controller 202 causes the print head 8 to perform a print operation on the basis of the print data via a head I/F 206. On this occasion, the print controller 202 drives, as appropriate, the first feeding unit 6A, the second feeding unit 6B, the manual feeding unit 6C, the conveying rollers 7, the discharging roller 12, and the flapper 11 illustrated in FIG. 1, via a conveyance control unit 207, and performs feeding and conveyance of the print medium S.

The conveyance control unit 207 is connected to a detection unit 212 configured to detect a conveyance state of the print medium S and a drive unit 211 configured to drive a plurality of drive rollers, and controls feeding and conveyance of the print medium S using the drive unit 211, on the basis of a detection result obtained from the detection unit 212. The sensor unit 212 has detection members 20 configured to detect the presence or absence of the print medium S, and an encoder 21 configured to detect the amount of rotation of the drive rollers.

During conveyance of the print medium S by the conveyance control unit 207, a print operation is performed by the print head 8 according to an instruction from the print controller 202.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
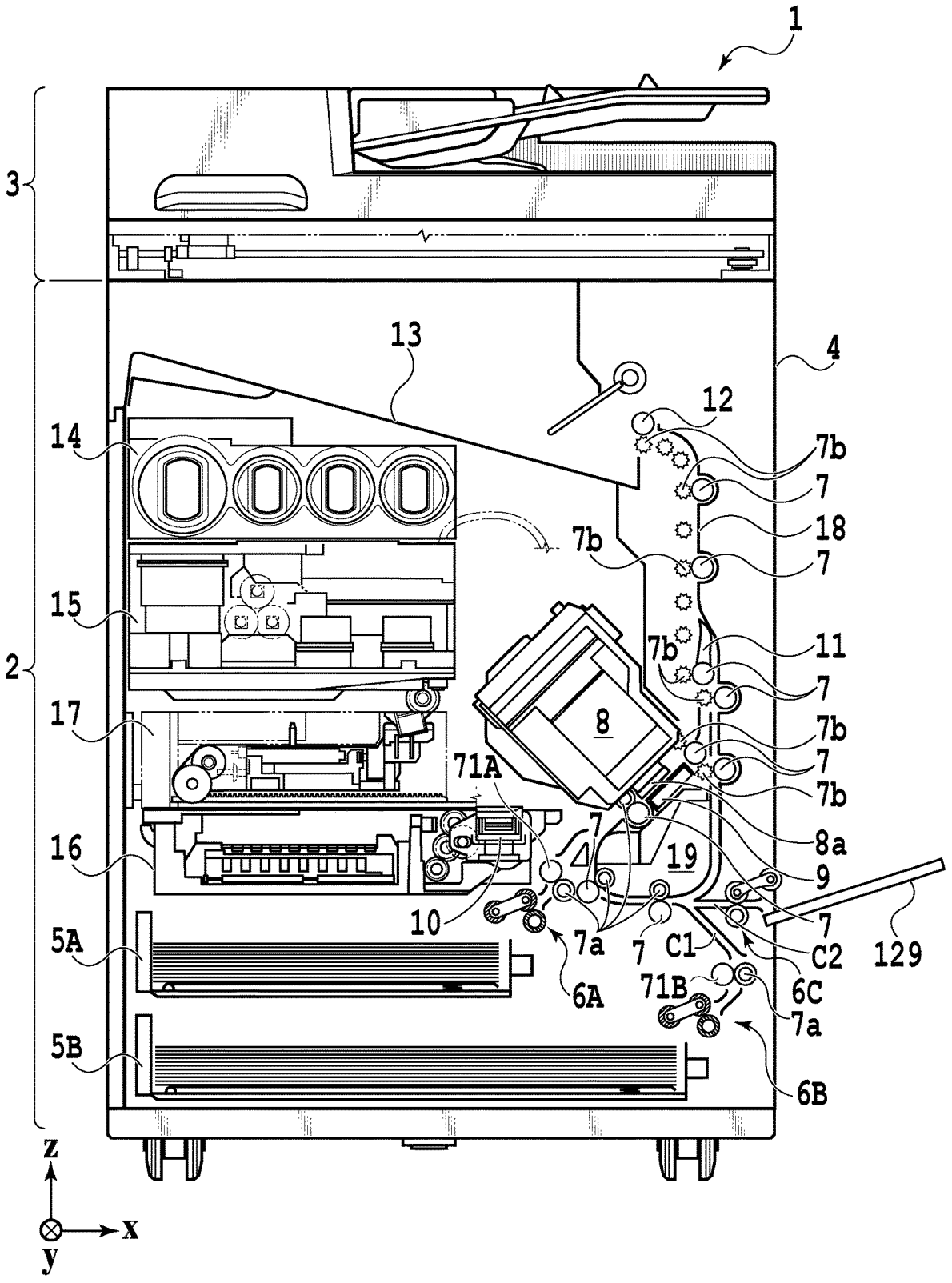
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
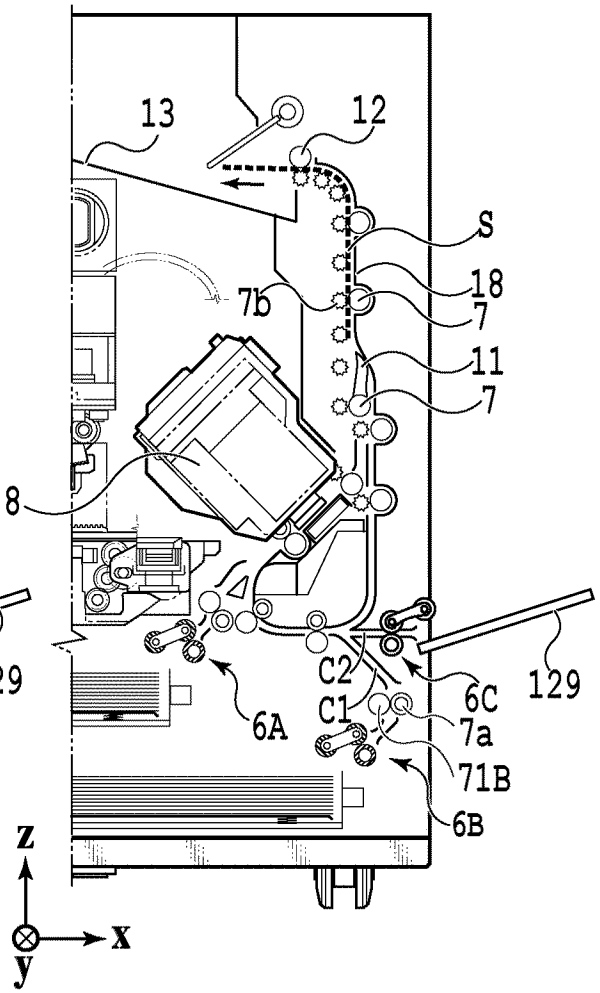
FIGS. 4A to 4C are conveying path diagrams of a print medium fed from a first cassette.
Figure 4B:
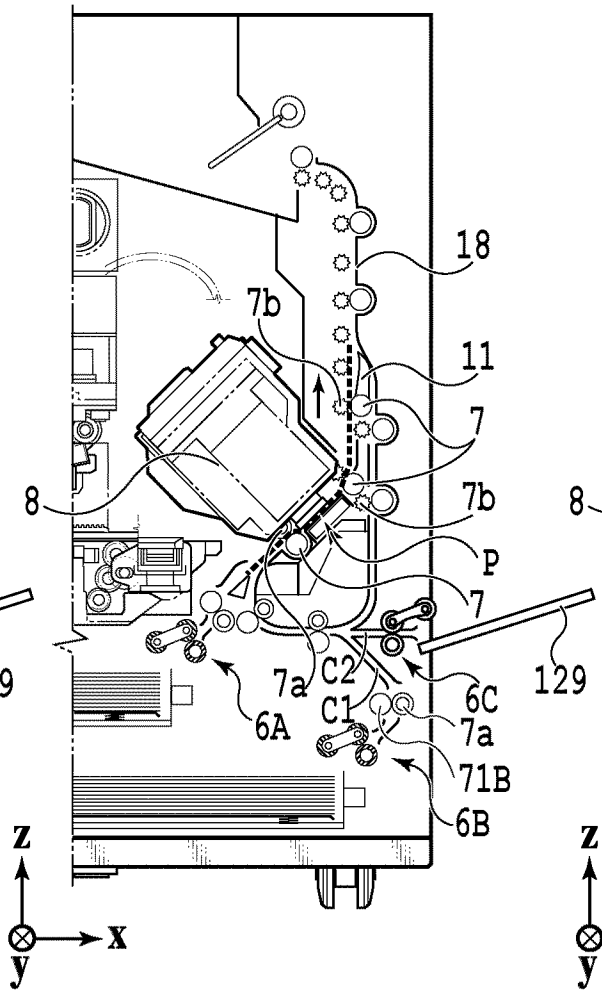
Figure 4A:
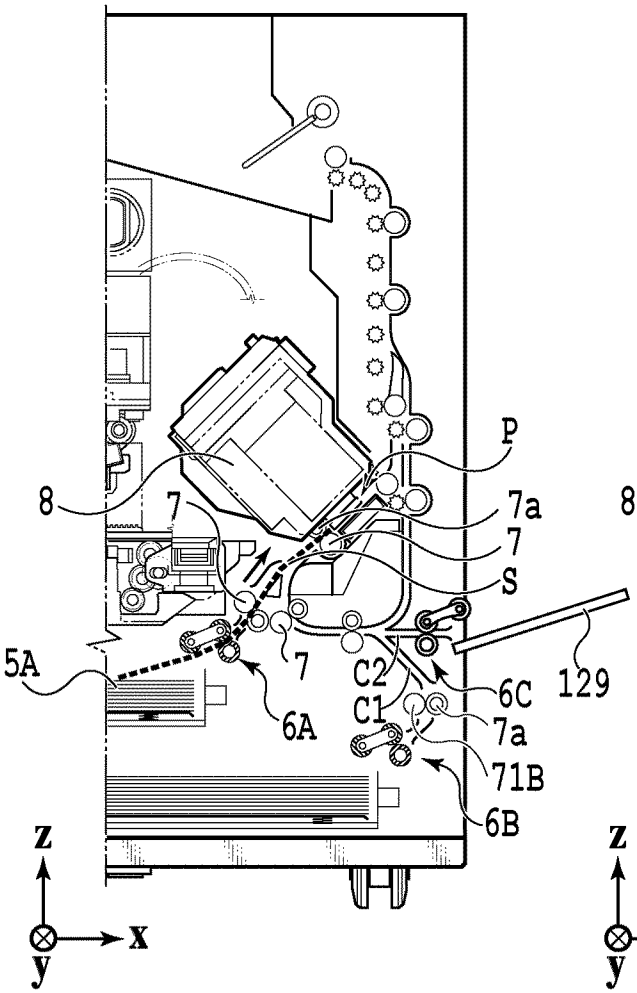

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In a print area P, ink is ejected toward the print medium S from the plurality of ejection openings provided on the print head 8. The print medium S which has reached the print area is supported by the platen 9 at one side (back side (second side)) which is not facing the print head, with the distance between the ejection opening surface 8*a* and the print medium S being kept constant. The print medium S, after landing of ink thereon, is conveyed upward in the vertical direction of the printing apparatus 1 along the guide 18, passing through the left side of the flapper 11 whose tip is inclined to the right, while being guided by the conveying rollers 7 and the spurs 7*b*. FIG. 4B illustrates a state in which the front end of the print medium S is conveyed upward in the vertical direction, passing through the print area P. The travel direction of the print medium S has been changed from a position of the print area P inclined about 45 degrees relative to the horizontal direction to upward in the vertical direction by the conveying rollers 7 and the spurs 7*b*.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 facing downward.

Figure 5C:
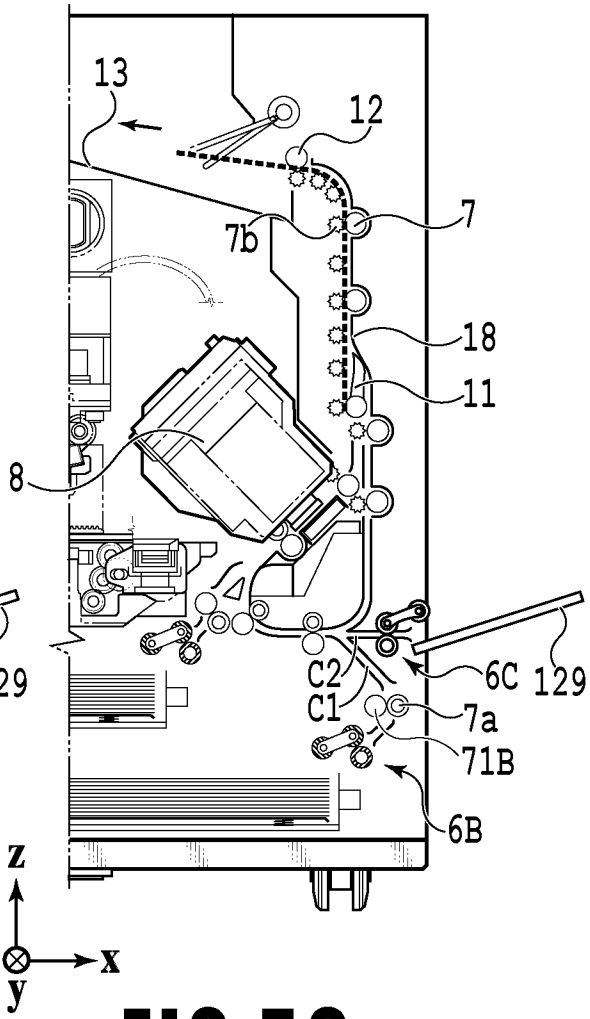
FIGS. 5A to 5C are conveying path diagrams of a print medium fed from a second cassette.
Figure 5B:
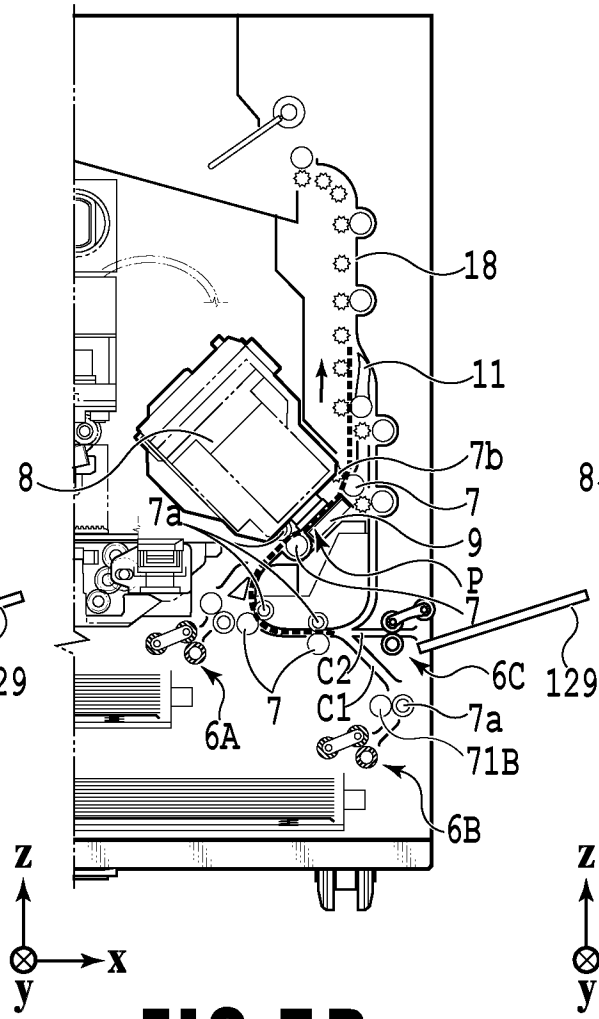
Figure 5A:
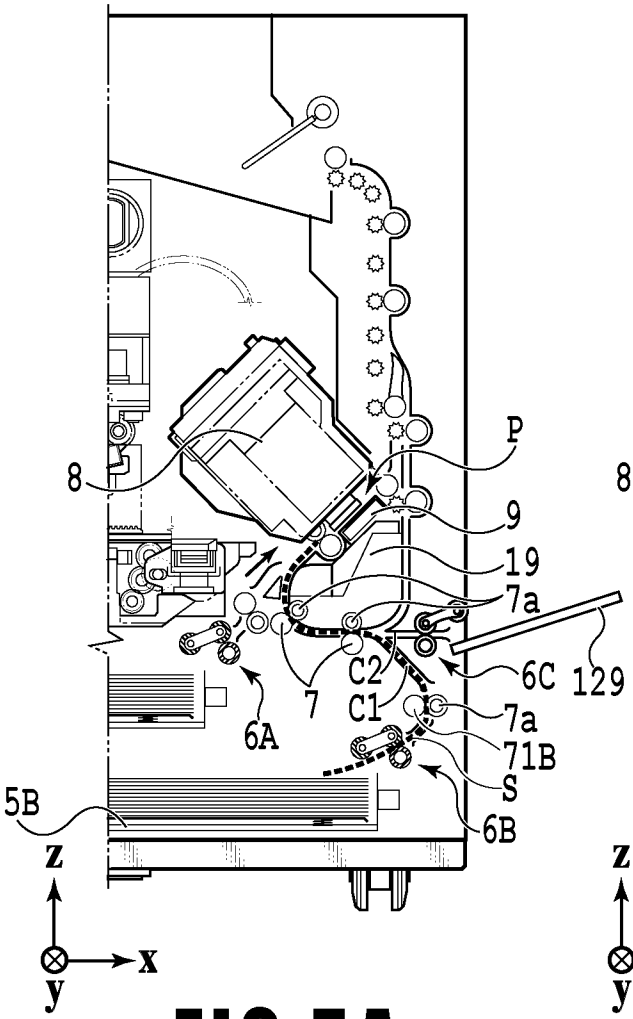

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figure 6D:
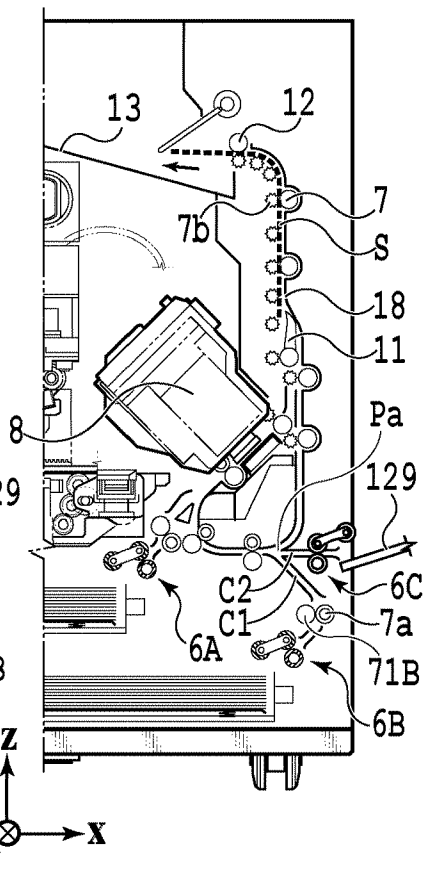
FIGS. 6A to 6D are conveying path diagrams in the case of performing print operation for the back side of a print medium.
Figure 6C:
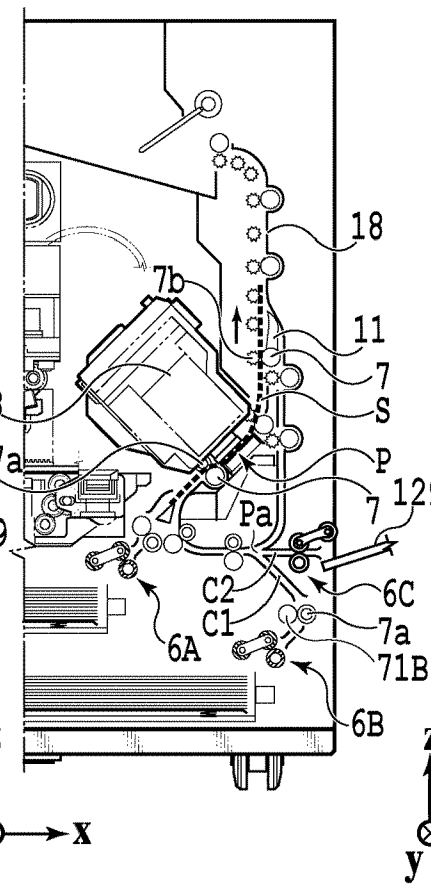
Figure 6B:
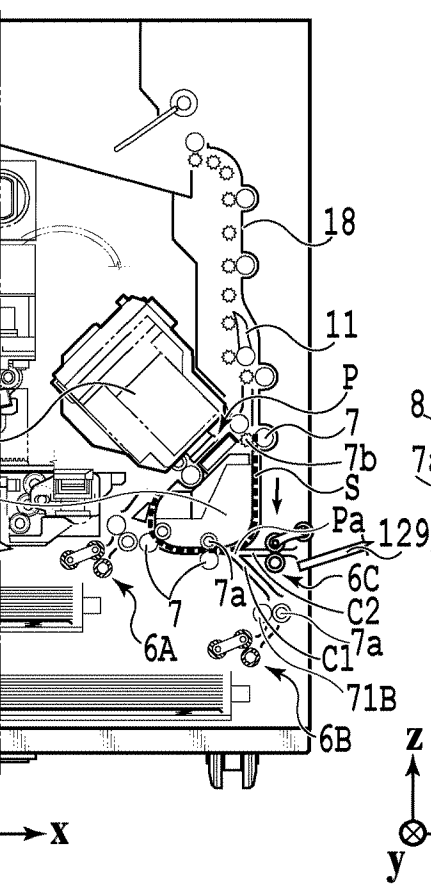
Figure 6A:
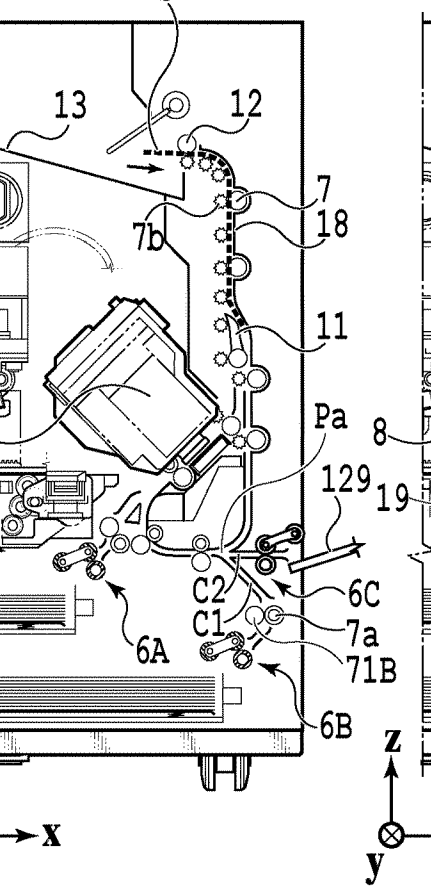

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

As illustrated in FIGS. 6A to 6D and FIG. 12, the printing apparatus 1 in the present embodiment has a conveying path C2 connected to the manual feeding unit (second feeding part) 6C configured to feed print media stacked on the manual feeding tray 129, besides the conveying path described above. The manual feeding unit 6C is intended to feed a relatively small amount of the print media S stacked on the manual feeding tray (second support part) 129 protruding from one side (right side in the drawing) of the printing apparatus 1 to the internal conveying path. The conveying path C2 of the print medium S which has been fed by the manual feeding unit 6C joins with an S-shaped conveying path C1 at a joining position Pa, in the case of feeding the print medium S housed in the second cassette 5B. The feeding unit 6C feeds the print medium S to the conveying rollers 7 located downstream of the joining position Pa. Subsequently, the print medium is conveyed by the conveying rollers 7 and the pinch roller 7*a*, and reaches the print area P via the same conveying path as the conveying path C1 of the print medium S which has been fed from the second cassette. Note that the manual feeding unit 6C will be described in detail below.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
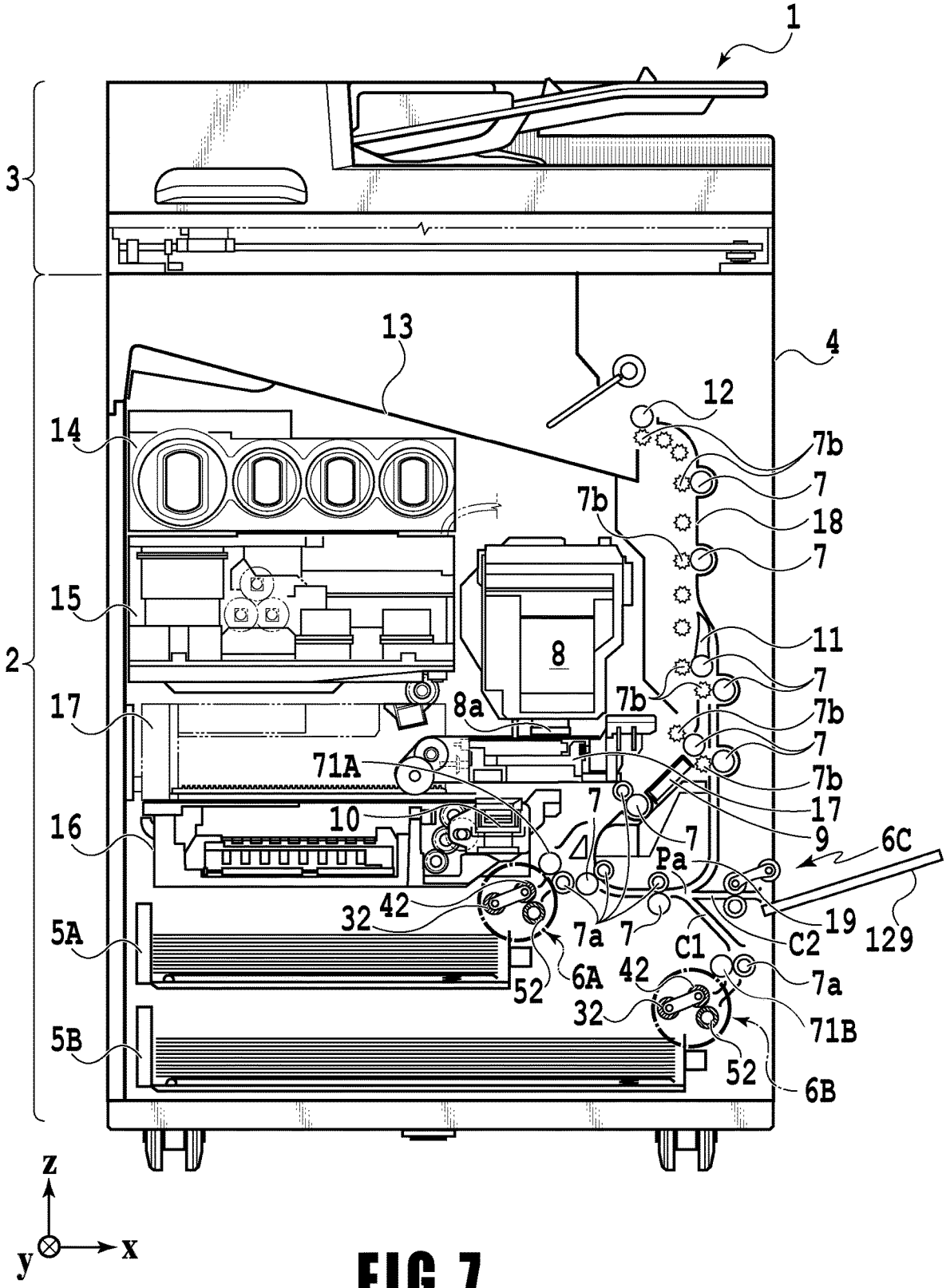
FIG. 7 illustrates the printing apparatus being in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8:
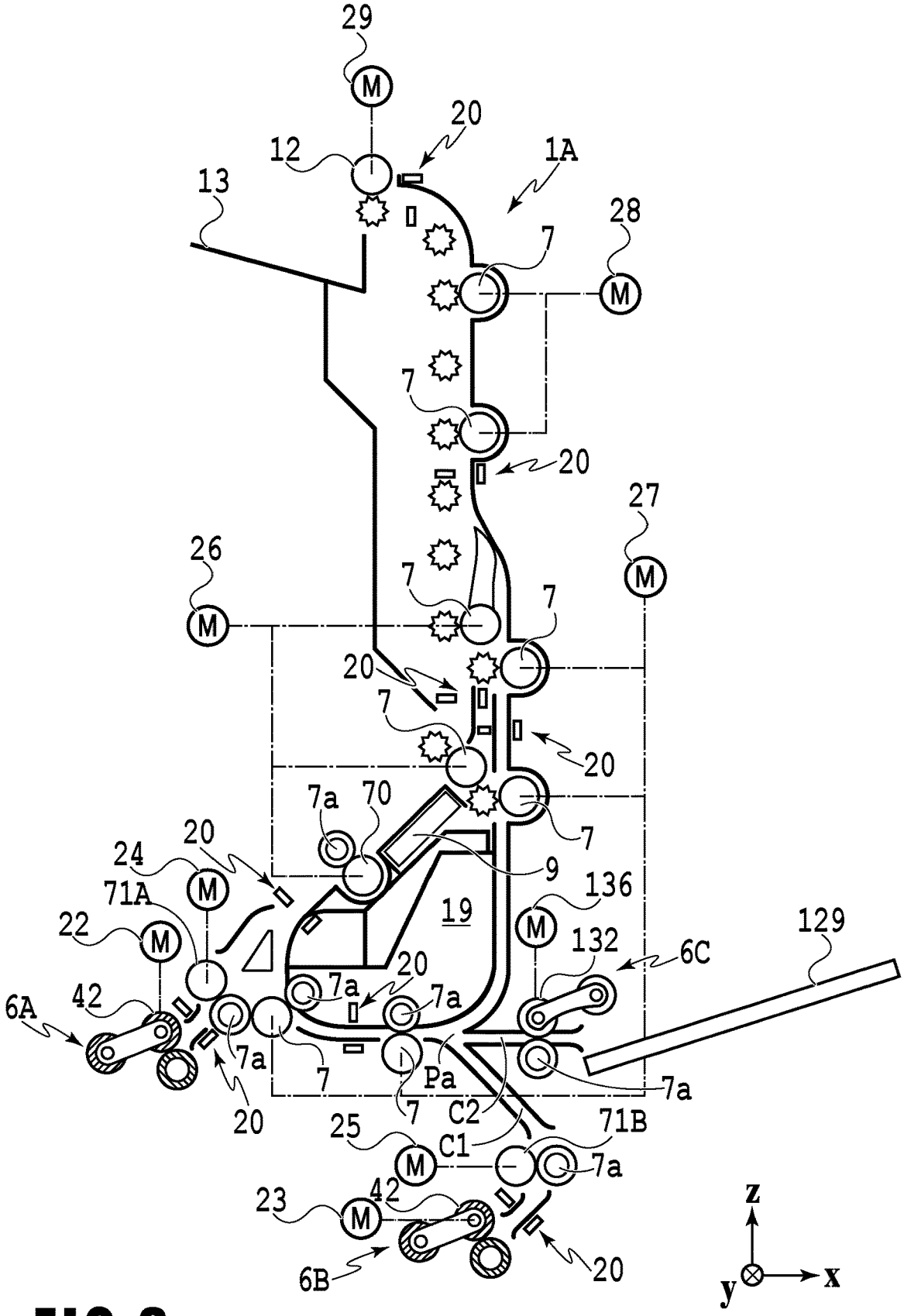
FIG. 8 illustrates a correspondence relation between a conveying roller and a motor.

FIG. 8 illustrates a correspondence relation between a plurality of motors and drive rollers in the printing apparatus 1. A first feeding motor 22 rotates a second feeding roller 42A described below, which is provided in the first feeding unit 6A for feeding the print medium S from the first cassette 5A. A second feeding motor 23 rotates a second feeding roller 42B provided in the second feeding unit 6B for feeding the print medium S from the second cassette 5B. A third feeding motor 136 drives a second manual feeding roller 132 provided in the manual feeding unit 6C for feeding the print medium S from a manual feeding tray 81.

A first conveying motor 24 drives a first intermediate roller 71A which first conveys the print medium S fed by the first feeding unit 6A. A second conveying motor 25 drives a second intermediate roller 71B which first conveys the print medium S fed by the second feeding unit 6B.

A main conveying motor 26 drives a main conveying roller 70 provided upstream of the platen 9 to mainly convey the print medium S being subjected to printing. In addition, the main conveying motor 26 drives the two conveying rollers 7 provided downstream of the platen 9 to convey, further downstream, the print medium S being conveyed by the main conveying roller 70.

A third conveying motor 27 drives the two conveying rollers 7 which convey, downward, the print medium S subjected to printing on the first side. In addition, the third conveying motor 27 also drives the two conveying rollers 7 provided along the inner guide 19. The two conveying rollers 7 convey, toward the print head 8, the print medium S fed from the second cassette 5B and conveyed by the second intermediate roller 71B, or the print medium S subjected to printing on the first side and turned over.

A fourth conveying motor 28 drives the two conveying rollers 7 which convey the print medium S upward or downward, after being subjected to printing operation. A discharging motor 29 drives the discharging roller 12 which discharges the print medium S subjected to printing toward the discharging tray 13. As thus described, the three feeding motors 22, 23 and 139, the five conveying motors 24 to 28, and the discharging motor 29 are respectively associated with one or more drive rollers.

On the other hand, the detection members 20 for detecting the presence or absence of the print medium S are provided at eight locations along the conveying path. Each of the detection members 20 includes a sensor and a mirror provided across the conveying path, with a sensor having a light emitting unit and a light receiving unit being provided on one side of the conveying path, and a mirror being provided on the other side of the conveying path at a position facing the sensor. According to whether or not the light-receiving unit detected light which has been emitted from the light emitting unit of the sensor and reflected by the mirror, the presence or absence of the print medium S, i.e., the passage of the front end or back end, is determined.

The conveyance control unit 207 drives the first feeding motor 22, the second feeding motor 23 and the third feeding motor 136, the conveying motors 24 to 28, and the discharging motor 29, individually, on the basis of respective detection results of the plurality of detection members 20, and an output value of an encoder configured to detect the amount of rotation of each drive roller. Conveyance in the apparatus as a whole is controlled thereby.

The printing apparatus 1 in the present embodiment as described above includes a print head (printing unit) 8 configured to perform printing on the print medium S, and a feeding device 1A configured to feed the print medium S to the print head 8. The feeding device 1A has first and second feeding units (first feeding parts) 6A and 6B, a manual feeding unit (second feeding part) 6C, a feeding device configured to selectively convey the print medium S, and a conveying device configured to convey the print medium S which has been fed.

In addition, the feeding device 1A in the present embodiment has the first cassette 5A and the second cassette 5B provided on two decks, namely, an upper deck and a lower deck, as a stacking unit configured to stack the print media S. As has been described above, the first feeding unit 6A is provided in the vicinity of the first cassette 5A, and the second feeding unit 6B is provided in the vicinity of the second cassette 5B, respectively. The first feeding unit 6A provided in the vicinity of the first cassette 5A and the second feeding unit 6B provided in the vicinity of the second cassette 5B have a similar configuration except for the difference in the largest size of the print medium S that may be fed. Therefore, in the following, description will be provided taking as an example the second feeding unit 6B that feeds from the second cassette 5B illustrated in FIG. 9. Note that the directions indicated by x, y and z in the drawing are similar to those in FIG. 1.

Figure 9:
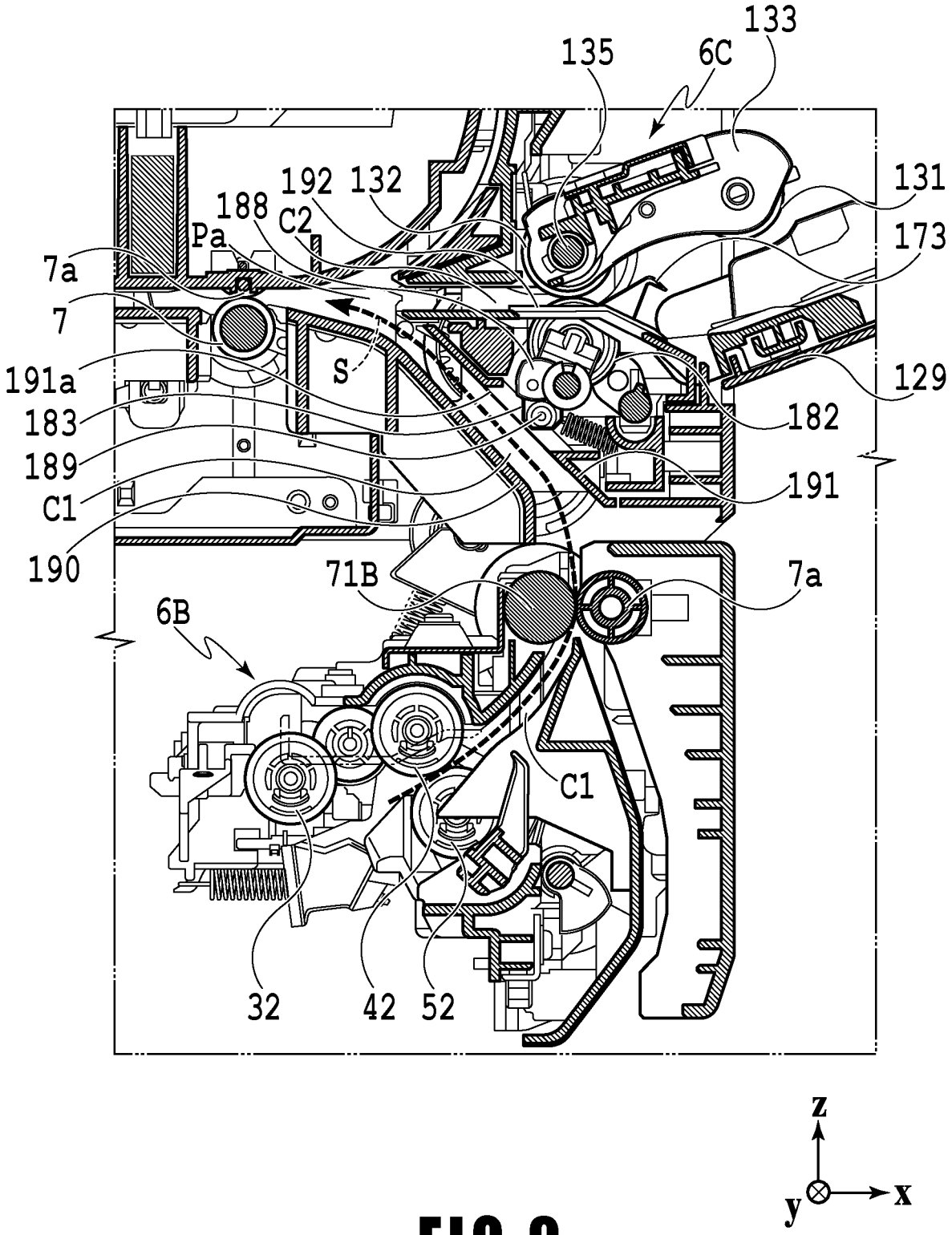
FIG. 9 is a cross-sectional view illustrating a first feeding unit and a second feeding unit.

FIG. 9 is a vertical-sectional view illustrating the second feeding unit 6B and the manual feeding unit 6C in more detail for the configuration of the part A illustrated in FIG. 1.

The second feeding unit 6B, which is intended to feed the print medium S one by one from the second cassette 5B illustrated in FIG. 1, includes a first feeding roller 32, a second feeding roller 42, a separation roller 52, or the like. The second feeding roller 42 is rotated by the aforementioned first feeding motor (feeding roller drive device) 22 serving as the driving source, and the rotation force thereof is transmitted to the first feeding roller 32 via a predetermined rotation transmission mechanism.

In the case of feeding the print medium S, the first feeding roller 32 abuts the top surface of the print media S housed in the second cassette 5B (see FIG. 1) and sends the print medium S from the second cassette 5B. The print medium S fed from the second cassette 5B is nipped between the second feeding roller 42 and the separation roller 52 and fed to the conveying path C1. The print medium S fed from the second cassette 5B is nipped between the first intermediate roller 71B and the pinch roller 7*a*, and conveyed downstream along the curved conveying path C1. The print medium S conveyed by the first intermediate roller 71B and the pinch roller 7*a* is conveyed by the two conveying rollers 7 and the pinch roller 7*a* provided on the conveying path C1, while being bent into an S-shape, and conveyed to the print area (receiving position) P where the platen 9 and the print head 8 face each other.

The conveying path C1 over which the print medium S fed from the second cassette 5B is conveyed to the platen 9 has a spatial area formed thereon so that the print medium S may be transferred smoothly by a plurality of guides. In the present embodiment, there are provided guides 190 and 191 facing each other across a predetermined gap, and a guide 192 provided on the manual feeding unit, or the like, as guides, in addition to the aforementioned guide 18 and the inner guide 19. The guides 190 and 191 form the conveying path (first conveying path) C1, and the guide 192 forms the second conveying path C2. Additionally, the guide 191 adjacent to the manual feeding unit 6C, which will be described below, has an opening 191*a* formed thereon. A part of the components of the manual feeding unit 6C faces the opening 191*a*, and the part of the components is allowed to protrude or retract relative to the conveying path C1, in a manner passing through the opening 191*a* as will be described below.

On the other hand, above the second feeding unit 6B, there is provided the manual feeding unit 6C configured to feed the print medium S toward the conveying path C1 from the manual feeding tray 129 protruding toward the side of the casing 4. The manual feeding tray 129 may have a plurality of sheets of the print media S stacked thereon, and the print media S stacked thereon are fed by the manual feeding unit 6C in turn one by one from the top sheet of the print media S.

The feeding unit 6C has a first manual feeding roller 131, a second manual feeding roller 132, and a separation roller 182 provided thereon. The first manual feeding roller 131 and the second manual feeding roller 132 are rotatably supported by a roller holding member 133 across a predetermined gap. The second manual feeding roller 132 is rotated by driving force of the third motor 136, and the rotation force thereof is transmitted to the first manual feeding roller 131 via a predetermined power transmission mechanism.

The roller holding member 133 is moveable upward and downward around an axial center of a roller drive shaft 135, which is the drive shaft of the second manual feeding roller 132. Moving the roller holding member 133 downward around the roller drive shaft 135 causes the first manual feeding roller 131 to abut the top surface of the top sheet of the print media S stacked on the manual feeding tray 129. In addition, moving the roller holding member 133 upward around the roller drive shaft 135 separates the first manual feeding roller 131 from the top surface of the print media S stacked on the manual feeding tray 129.

The second manual feeding roller 132 is fixed to the roller drive shaft 135, and held at a constant position regardless of the movement position of the roller holding member 133. In addition, the separation roller 182 is held by a separation roller holding member 183 in a manner contactable to or separable from the second manual feeding roller 132, and is capable of nipping the print medium S together with the second manual feeding roller 132.

Figure 10:
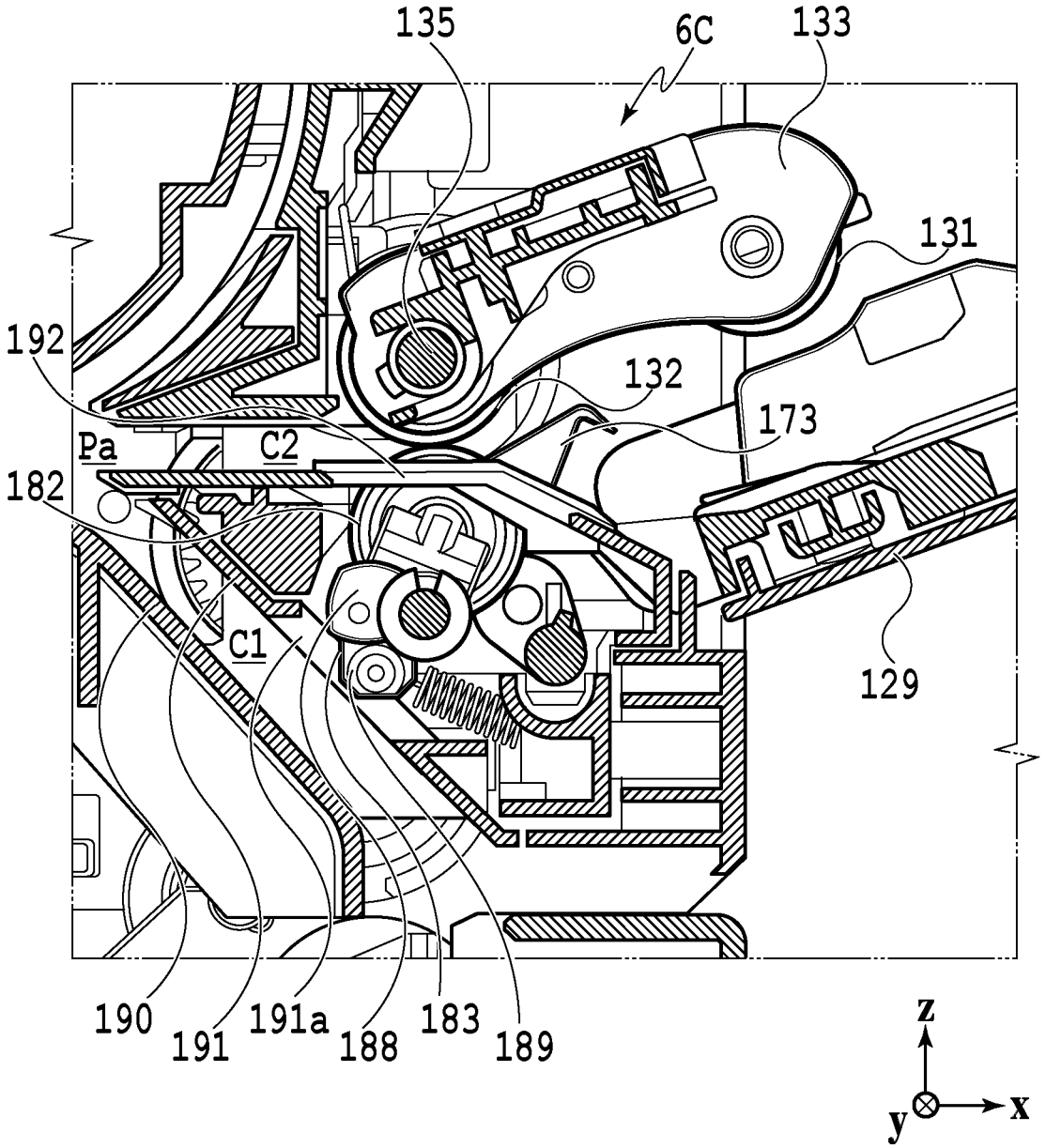
FIG. 10 is a cross-sectional view illustrating the second feeding unit illustrated in FIG. 9 and the vicinity thereof in an enlarged manner.

Next, the operation of each of the aforementioned rollers on the manual feeding unit 6C will be described. FIGS. 9 and 10 illustrate an initial state before stacking the print media S on the manual feeding tray 129. In the initial state, the roller holding member 133 of the manual feeding unit 6C moves upward with the roller drive shaft 135 being the center, and the first manual feeding roller 131 is separated upward from the top surface of the manual feeding tray 129. In this state, the user may stack as many sheets of the print media as possible on the manual feeding tray 129 to an extent that they do not contact the first manual feeding roller 131.

In addition, the separation roller 182 is held by a separation mechanism described below including the separation roller holding member 183 at a raised position abutting the second manual feeding roller 132. On this occasion, the separation roller holding member 183 is held at a position further outward than the inner edge of the opening 191*a* formed on the guide 191 forming the conveying path C1, i.e., a position that does not protrude into the conveying path C1. Therefore, in the initial state, it is possible to smoothly transfer the print medium S along the conveying path C1 without interfering with the separation roller holding member 183, as indicated by the arrow in FIG. 9, even in the case where feeding and conveyance are performed by the second feeding unit 6B and the conveying roller.

Figure 11:
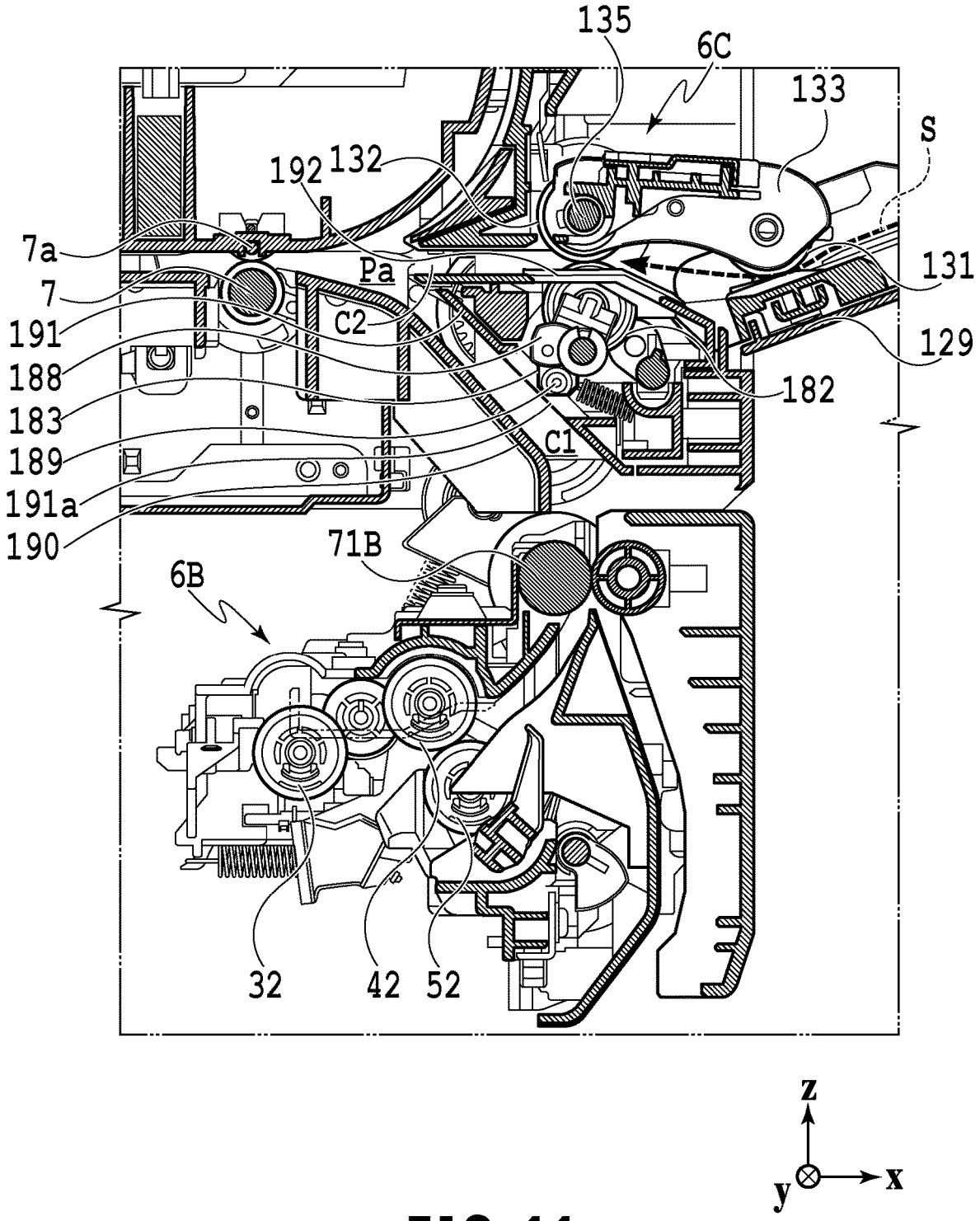
FIG. 11 is a cross-sectional view illustrating a state of starting a feed operation of the second feeding unit.

FIG. 11 illustrates a state in which feeding (manual feeding) of the print medium S stacked on the manual feed tray 129 is started. In the case of starting manual feeding, the roller holding member 133 moves downward around the roller drive shaft 135, and the first manual feeding roller 131 abuts the top sheet of the print media S stacked on the manual feeding tray 129. Subsequently, the third feeding motor 136 is driven so as to rotate the second manual feeding roller 132 together with the roller drive shaft 135, whereby the rotation force thereof is transmitted to the first manual feeding roller 131 via the power transmission mechanism, which also rotates the first manual feeding roller 131.

Rotation of the first manual feeding roller 131 causes the print medium S abutting the first manual feeding roller 131 to be fed to the second manual feeding roller 132 along the guide 192. The print medium S which has reached the second manual feeding roller 132 is nipped by the second manual feeding roller 132 and the separation roller 182 which are rotating. The separation roller 182 has coupled thereto a torque limiter 184 described below, and predetermined braking is applied to the rotation. Therefore, even in the case where one or more sheets of the print media S located at a lower position are doubly fed from the manual feeding cassette together with the top sheet of the print media S, they will be separated into the top sheet of the print media S and the other sheets of the print media by the separation roller 182 having a braking force applied thereto. Accordingly, only the top sheet of the print media S is conveyed downstream of the second manual feeding roller 132. Note that the separated sheets of the print media S are fed back to the manual feeding tray 129 by a return member 173 protruding from the guide 192 as illustrated in FIG. 12 and moving toward the manual feeding tray 129.

Figure 12:
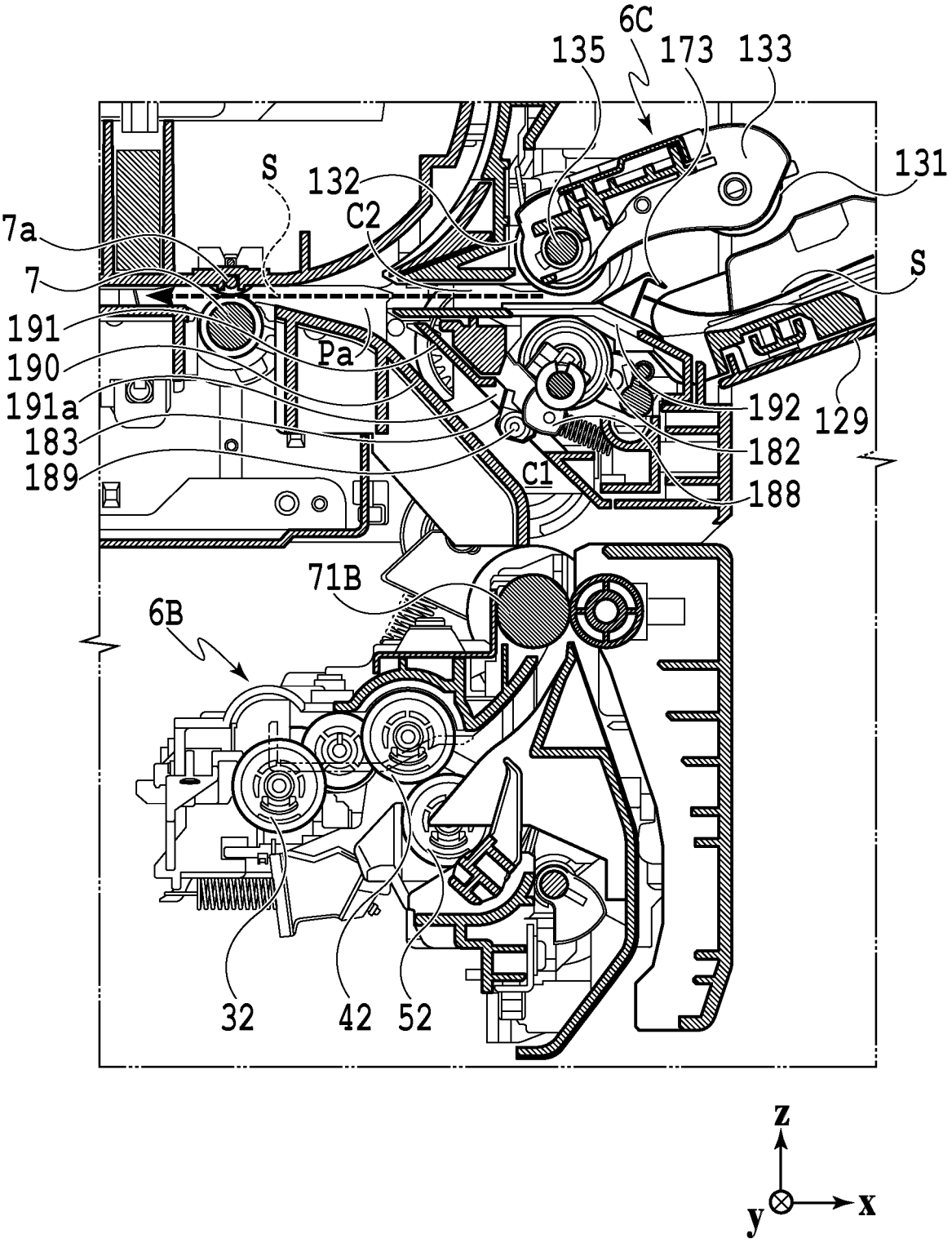
FIG. 12 is a cross-sectional view illustrating a state in which a print medium has been fed to the conveying roller.

FIG. 12 illustrates a state in which the print medium S fed by the second manual feeding roller 132 is fed in-between the conveying roller 7 and the pinch roller 7*a*. Upon starting feeding by the manual feeding unit 6C, the conveying roller 7 is driven by the third conveying motor 27 and starts rotating. Accordingly, the print medium S fed to the conveying roller 7 is nipped between the rotating conveying roller 7 and the pinch roller 7*a*, and conveyed downstream of the conveying path C1 by both rollers 7 and 7*a*.

Upon starting conveying by the conveying roller 7, the separation roller 182 is separated from the second manual feeding roller 132 and releases the nipping of the print medium S to reduce the load on the conveying roller 7. Descending of the separation roller 182 is caused by descending of the separation roller holding member 183 caused by a cam described below.

In the initial state (FIG. 10) before the separation roller holding member 183 descends, the whole of the separation roller holding member 183 is located outside the inner edge of the opening 191*a* formed on the guide 191 (outside the conveying path C1). However, as illustrated in FIG. 12, descending of the separation roller holding member 183 allows a part thereof to protrude from the opening 191*a* toward the inside of the conveying path C1. In a state where the print medium S fed from the manual feeding unit 6C is being conveyed by the conveying rollers 7, the conveying path C1 is not used for conveying the print medium S. Therefore, the present embodiment moves the separation roller holding member 183 using the spatial area within the conveying path C1 in the not-in-use state. In other words, the configuration intends that a part of the spatial area formed by the conveying path C1 is doubly used as at least a part of the spatial area used during the conveying operation performed by the manual feeding unit (second feeding part) 6C, whereby it becomes possible to downsize the apparatus.

Next, the configuration and operation of the manual feeding unit 6C will be described in detail.

Figure 13:
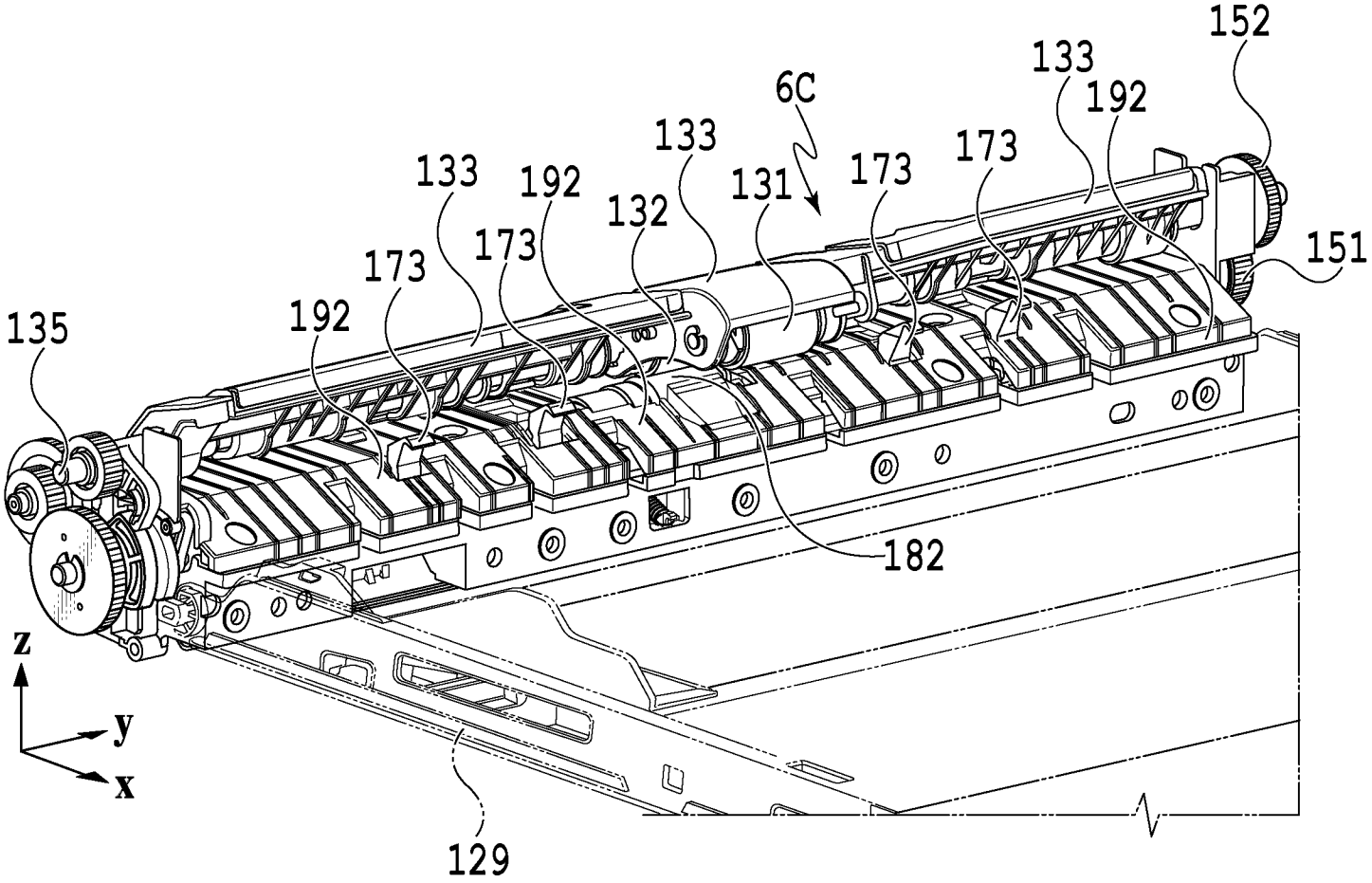
FIG. 13 is a perspective view illustrating an external appearance of the second feeding unit.

FIG. 13 is a perspective view illustrating the external appearance of the manual feeding unit 6C. Note that the directions indicated by x, y and z in the drawing are similar to those of FIG. 1.

As illustrated in FIG. 13, the manual feeding unit 6C extends in the y-direction (width direction of the print medium S), with the manual feeding tray 129 being fixed to one side thereof (the side located upstream or downstream in the conveying direction of the print medium S). In addition, the manual feeding unit 6C has provided thereon the guide 192 that guides the print media S stacked on the tray 129 to the aforementioned conveying path C1. On the lower part and both sides of the guide 192, there is provided an operation mechanism including a movement mechanism of the roller holding member 133 centered on the roller drive shaft 135, a manual feeding roller movement mechanism configured to move the manual feeding roller, a separation roller movement mechanism configured to move the separation roller 182, or the like. Note that, in the present embodiment, there is provided a plurality (four in the figure) of the return members 173 configured to return the print medium S remaining on the top surface of guide 192 to the manual feeding tray 129 at the time of manual feeding.

Figure 14:
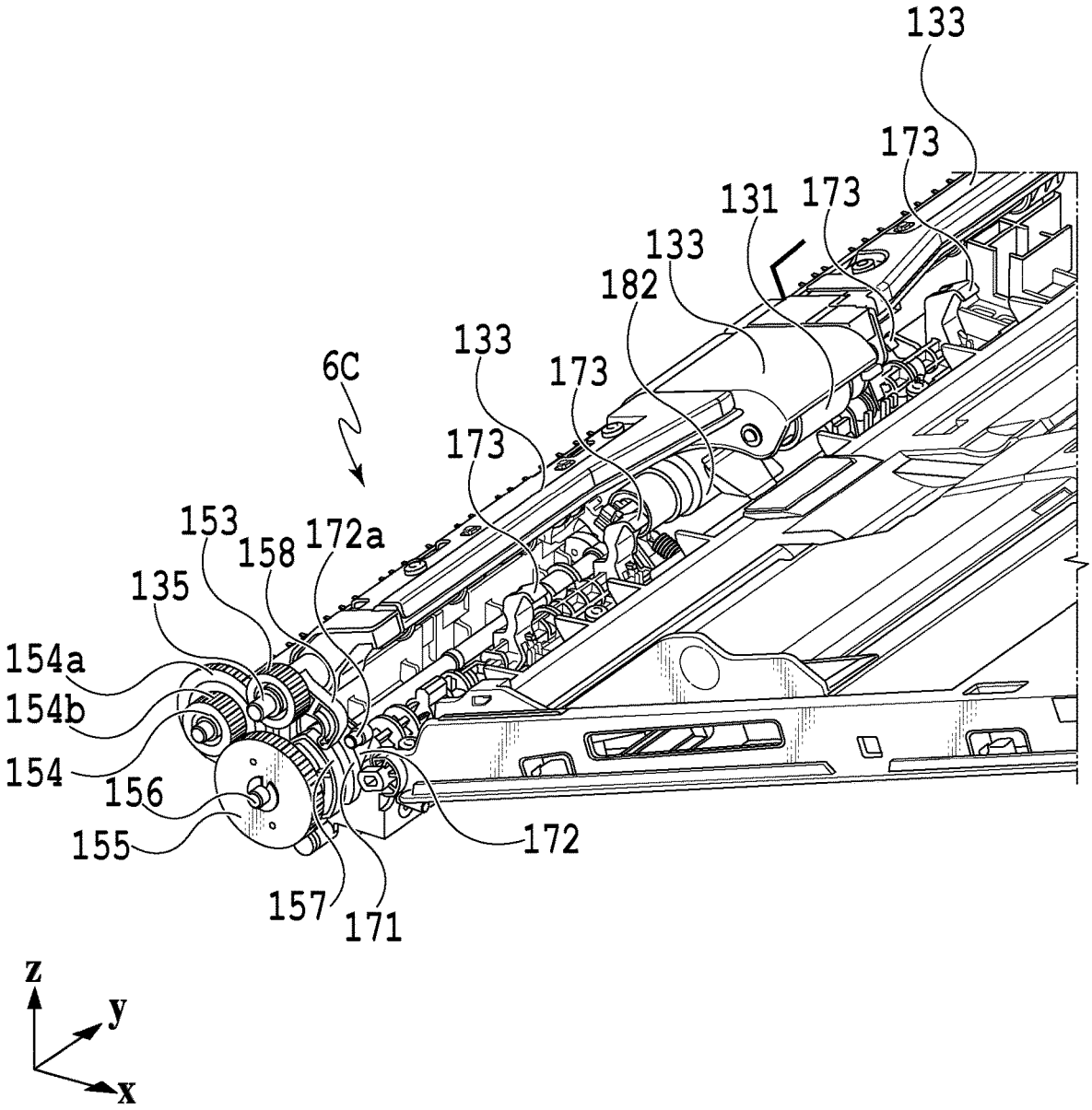
FIG. 14 is a perspective view illustrating an internal configuration of the second feeding unit.

FIG. 14 is a perspective view illustrating the internal configuration of the manual feeding unit 6C illustrated in FIG. 13 with the guide 192 removed therefrom. As illustrated in the drawing, the roller drive shaft 135 with the second manual feeding roller 132 fixed thereto extends in the y-direction. The roller drive shaft 135 is rotated by the driving force of the third feeding motor 136 (manual feeding motor), as illustrated in FIG. 8. The driving force of the third feeding motor 136 is transmitted to the roller drive shaft 135 via a predetermined power transmission mechanism including a gear 151 fixed to one end of the roller drive shaft 135 and a gear 152 cooperating therewith, as illustrated in FIG. 13. As has been described above, since the roller drive shaft 135 has the second manual feeding roller 132 fixed thereto, the second manual feeding roller 132 rotates together with the roller drive shaft 135, and the rotation force thereof is transmitted to the first manual feeding roller 131 by a predetermined power transmission mechanism provided on the roller holding member 133.

A drive gear 153 is fixed to the other end (left end in FIGS. 13 and 14) of the roller drive shaft 135. The rotation force of the drive gear 153 is transmitted to a spur gear 155 via a two-stage gear 154. Note that the two-stage gear 154 has a major diameter part 154*a* engaging with the drive gear 153, and a minor diameter part 154*b* engaging with the spur gear 155. The spur gear 155 is fixed to a separation drive shaft 156 extending in the y-direction, and the separation drive shaft 156 rotates together with the spur gear 155. The separation drive shaft 156 has fixed thereto a holding member movement cam 157 for controlling the movement of the roller holding member 133 in upward and downward directions, and a return cam 171 for controlling the movement of the return member 173. Both circumferential surfaces of the holding member movement cam 157 and the return cam 171 turn out to be cam surfaces having a predetermined profile.

One end of a follower arm 158 supported by the roller drive shaft 135 in a freely rotatable manner is constantly abutting the cam surface of the holding member movement cam 157, and rotates upward or downward conforming to the profile of the cam surface, around the roller drive shaft 135. The follower arm 158 is fixed to the aforementioned roller holding member 133 supported by the roller drive shaft 135 in a freely rotatable manner. Therefore, the roller holding member 133 rotates upward or downward together with the follower arm 158, around the roller drive shaft 135.

In addition, a cam follower 172*a* provided on a follower member 172 is constantly abutting the cam surface of the return cam 171. Movement of the cam follower 172 conforming to the profile of the cam surface of the return cam 171 causes the follower member 172 to perform a predetermined movement including a y-direction component and a z-direction component. The follower member 172 has a plurality of the aforementioned return members 173 attached thereto, and each return member 173 moves along with the movement of the follower member 172. In the movement, the return members 173 perform an operation of returning the print media S protruding from the top surface of guide 192 and remaining on the guide 192 to the manual feeding tray 129, as has been described above. In addition, at the time of feeding the print medium S, the return members 173 move to an evacuation position below the top surface of the guide 192 to avoid preventing the feed of the print medium S (see FIG. 11).

Figure 15:
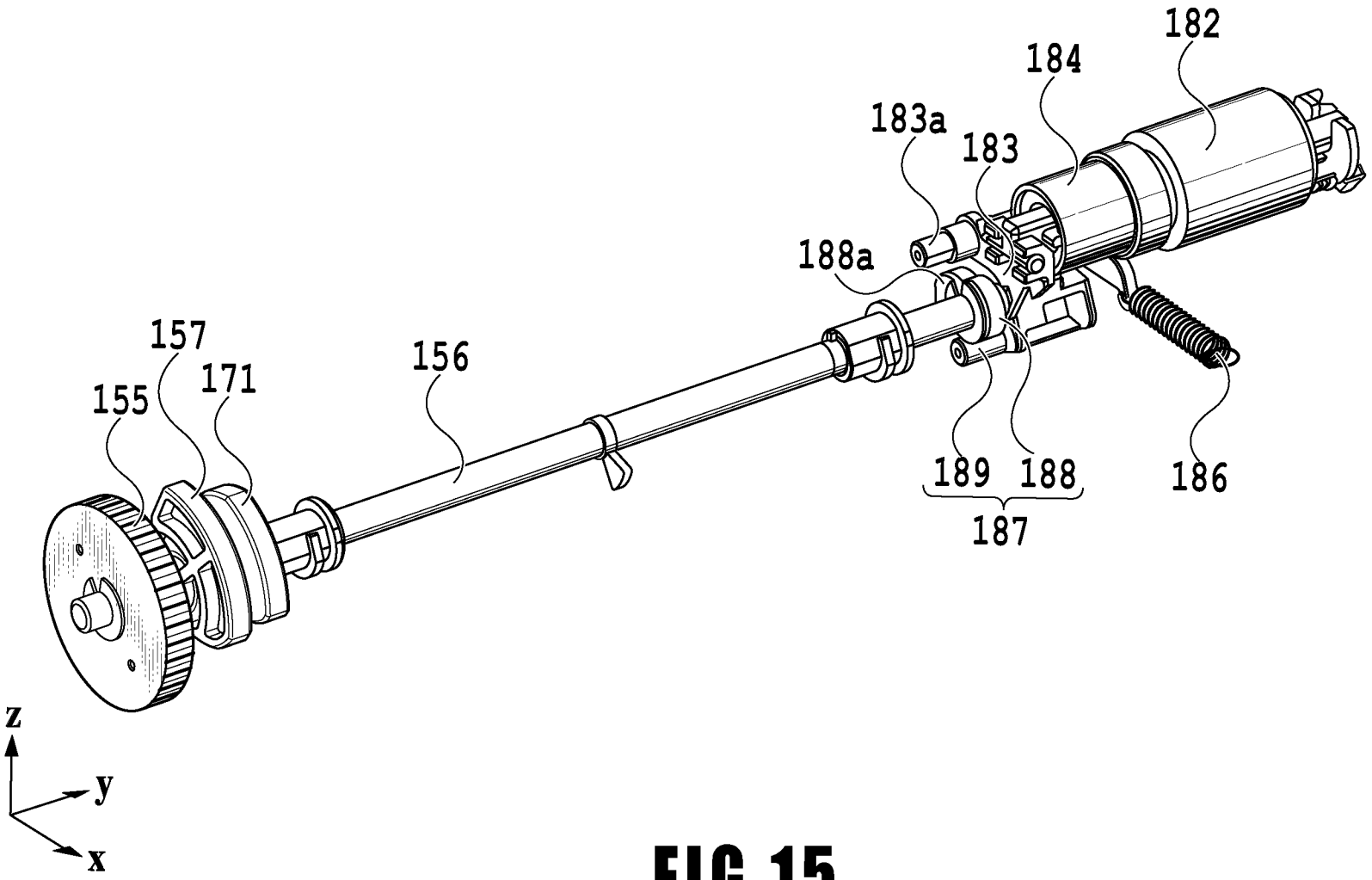
FIG. 15 is a perspective view illustrating a separation mechanism in the second feeding unit.
Figure 16:
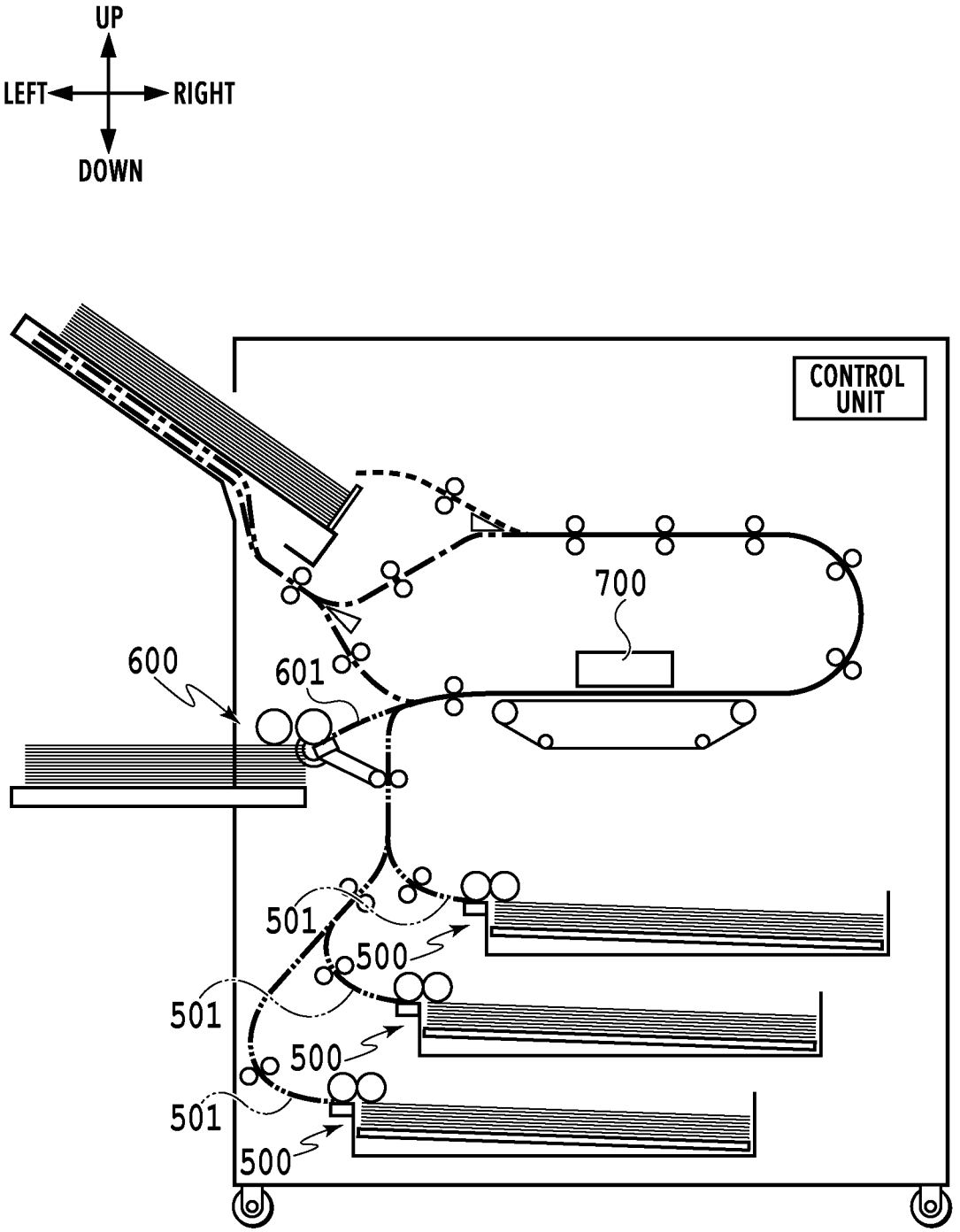
FIG. 16 is a cross-sectional view illustrating a feeding device in a conventional printing apparatus.

FIG. 15 is a perspective view illustrating the separation roller movement mechanism that moves the separation roller 182 upward or downward. The separation roller movement mechanism has the separation roller holding member 183 rotatably supporting the separation roller 182. The separation roller holding member 183 has a spindle 183*a* provided in a protruding manner at a position offset from the center of rotation of the separation roller 182, the spindle 183*a* being rotatably supported by a predetermined support member of the manual feeding unit 6C. In other words, the separation roller holding member 183 is supported to be allowed to perform rotational motion including upward and downward direction component (z-direction component) in a predetermined range of rotational angles, with the spindle 183*a* provided at a position offset from the center of rotation of the separation roller 182 being the center.

The rotational motion by the separation roller holding member 183 also causes the separation roller 182 to perform a pivoting motion and move upward or downward, around the spindle 183*a*. The upward or downward movement causes the separation roller 182 to abut or be separated from the second manual feeding roller 132. In other words, the separation roller 182 abuts the circumferential surface of the second manual feeding roller 132 or the print medium S due to the upward movement, and is separated from the second manual feeding roller 132 or the print medium S due to the downward movement. In addition, the separation roller holding member 183 is biased by a spring 186 (biasing device) toward a direction (upward) abutting the second manual feeding roller 132.

Furthermore, the separation roller movement mechanism has a separation mechanism (separation roller movement unit) 187 configured to depress the separation roller holding member 133 against the biasing force of the spring 186, and separates the separation roller 182 from the second manual feeding roller 132. The separation mechanism 187 is formed by a separation cam 188 fixed to the front end of the separation drive shaft 156, and a cam follower 189 fixed to the separation roller holding member 183. The cam follower 189 is provided at a position facing the circumferential surface of the separation cam 188.

Upon reaching a predetermined rotation phase by the separation cam 188 together with the separation drive shaft 156, a protrusion 188*a* provided on the circumferential surface of the separation cam 188 in a protruding manner abuts and depresses the cam follower 189. As a result, the separation roller holding member 183, together with the cam follower 189, performs a downward pivoting operation against the biasing force of the spring 186, around the spindle 183*a*. Accordingly, the separation roller 182 is separated from the second manual feeding roller 132, as illustrated in FIG. 12. On this occasion, a part of the separation roller holding member 183 of the separation mechanism 187 and the cam follower 189 protrude from the opening 191*a* of the guide 191 forming the conveying path C1 to the spatial area of the conveying path C1.

Subsequently, rotation of the separation drive shaft 156, up to a predetermined rotation phase, displaces the protrusion 188*a* of the separation cam 188 from the position abutting the cam follower 189, and the downward pressing force is released. As a result, the biasing force of the spring 186 causes the separation roller holding member 183 to pivot upward, around the spindle 183*a*, and abut the circumferential surface of the second manual feeding roller 132.

Raising of the separation roller holding member 183 causes the cam follower 189 protruding into the spatial area of the conveying path C1, and a part of the separation roller holding member 183 supporting such, to move outward from the opening 191*a* of the guide 191, as illustrated in FIG. 10. Accordingly, the conveying path C1 turns into a state that allows feeding and conveying the print medium S from the second cassette 5B.

As has been described above, the present embodiment is configured so that a part of the separation roller holding member 183 and the cam follower 189 protrude toward the conveying path C1, in the case of separating the separation roller 182 from the second manual feeding roller 132, and upon separating the separation roller 182, it is retracted from the conveying path C1. In other words, since a configuration is employed that advances or retracts the cam follower and a part of the roller holding member 183 using a part of the conveying path C1, it becomes possible to reduce the spatial area occupied by the manual feeding unit 6C, and it becomes possible to downsize the media feeding unit.

Other Embodiments

In the aforementioned embodiment, there has been proposed a configuration that doubly uses a part of the spatial area of the conveying path C1 as a part of the separation roller holding member 183 and a part of the spatial area used during the operation of the cam follower 189. However, without being limited to the roller holding member 133 and cam follower 189, it is also possible to configure the spatial area used during the operation of one or more members forming the manual feeding unit 6C to be doubly used as a part of the space in the conveying path C1. For example, it is also possible to doubly use a part of the spatial area used during the operation of the separation cam 188 as the space in the conveying path C1.

In addition, depending on the position where the manual feeding cassette and the manual feeding unit are provided, it is also possible to doubly use a part of the spatial area within the conveying path of the print medium being fed from the first cassette 5A as a part of the spatial area used during the operation of the separation roller holding member. Furthermore, the present invention is also applicable to a printing apparatus employing a configuration that causes print media to be selectively fed from four or more support parts of storage media. For example, the configuration used in the aforementioned embodiment is also applicable to a printing apparatus that feeds print media from cassettes (first support parts) provided at three locations and a manual feeding tray (second support part) provided at a single location. In such a case, a spatial area of the conveying path of a print medium fed from a single cassette is intended to be doubly used as at least a part of the spatial area occupied during the operation of the manual feeding unit (second feeding part).

In addition, the present invention is also applicable to a printing apparatus using a printing method other than inkjet printing. For example, the present invention is applicable to feeding and conveyance of print media in various types of printing apparatuses such as a printing apparatus that performs printing using electrophotography, or a thermal printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-251727 filed Dec. 27, 2017, which is hereby incorporated by reference herein in its entirety.

What is claimed is:

1. A printing apparatus comprising:

a first feeding part configured to feed print media from a first support part supporting the print media;

a second feeding part configured to feed print media from a second support part supporting the print media, a print head configured to print on the print media fed by the first feeding part or the second feeding part;

a first conveying path where the print media fed by the first feeding part are conveyed to the print head; and a second conveying path where the print media fed by the second feeding part are conveyed to the print head, wherein at least a part of the second feeding part protrudes in a predetermined spatial area within the first conveying path during a feed operation of feeding print media from the second support part.

2. The printing apparatus according to claim 1, wherein the at least part of the second feeding part protruding into the predetermined spatial area retracts from the first conveying path before a print medium being fed by the first feeding part from the first support part to the first conveying path reaches the predetermined spatial area.

3. The printing apparatus according to claim 1, wherein the at least part of the second feeding part protrudes into the predetermined spatial area via an opening formed in the first conveying path, and retracts from the first conveying path.

4. The printing apparatus according to claim 1, wherein portions of the first conveying path and the second conveying path comprise a common path downstream of a predetermined joining position, the predetermined spatial area within the first conveying path being located upstream of the predetermined joining position.

5. The printing apparatus according to claim 1, wherein the first support part includes a cassette for stacking fixed-form print media, and the second support part includes a tray for stacking indeterminate-form print media.

6. The printing apparatus according to claim 5, wherein the first support part includes, at different positions, a plurality of cassettes capable of stacking fixed-form print media thereon, the first feeding part is provided corresponding to each of the plurality of cassettes so as to constitute a plurality of first feeding parts, the plurality of the first feeding parts and the second feeding part are selectively operated, and the at least part of the second feeding part is provided to be able to protrude into a spatial area within one conveying path out of a plurality of the conveying paths connected to each of the plurality of cassettes.

7. The printing apparatus according to claim 1, wherein a print medium fed via the second conveying path is conveyed to the print head by a conveying unit.

8. The printing apparatus according to claim 1, wherein the second feeding part includes:

a first feeding roller configured to feed a print medium supported by the second support part from the second support part;

a second feeding roller provided downstream of the first feeding roller;

a separation roller moveable between a nipping position where the print medium is nipped between the separation roller and the second feeding roller, and a spaced position where the separation roller is spaced from the print medium; and a separation roller movement unit configured to move the separation roller between the nipping position and the spaced position, and in a case in which the separation roller movement unit has moved the separation roller to the spaced position, at least a part of the separation roller movement unit protrudes into the predetermined spatial area and, in a case in which the separation roller movement unit has moved the separation roller to the nipping position, the at least part of the separation roller movement unit retracts from the first conveying path.

9. The printing apparatus according to claim 8, wherein the separation roller movement unit includes a roller holding member configured to rotatably hold the separation roller, and a spacing mechanism configured to move the roller holding member so that the separation roller moves from the nipping position to the spaced position, and in a case in which the separation roller is located at the spaced position, a part of at least one of the roller holding member and the spacing mechanism protrudes into the predetermined spatial area, and, in a case in which the separation roller is located at the nipping position, the roller holding member and the spacing mechanism are located at a retracted position from the first conveying path.

10. The printing apparatus according to claim 8, wherein the separation roller separates, out of a plurality of sheets of print media fed to the second feeding roller by the first feeding roller, sheets of print media other than a sheet of print media to be supplied to the print head from the sheet of print medium to be supplied to the print head.

11. A sheet feeding apparatus comprising:

a first feeding part configured to feed a sheet from a first support part supporting the sheet;

a second feeding part configured to feed a sheet from a second support part supporting the sheet;

a first conveying path where the sheet fed by the first feeding part is conveyed to a print head; and a second conveying path where the sheet fed by the second feeding part is conveyed to the print head, wherein at least a part of the second feeding part protrudes into a predetermined spatial area within the first conveying path during a feed operation of feeding the sheet from the second support part.

12. A printing apparatus comprising:

a first feeding part configured to feed print media from a first support part supporting the print media;

a second feeding part configured to feed print media from a second support part supporting the print media;

a print head configured to print on the print media fed by the first feeding part or the second feeding part;

a first conveying path where the print media fed by the first feeding part are conveyed to the print head; and a second conveying path where the print media fed by the second feeding part are conveyed to the print head, wherein at least a part of the second feeding part moves between a first position where the at least part of the second feeding part protrudes into a predetermined spatial area and a second position where the at least part of the second feeding part is retracted from the predetermined spatial area.

13. The printing apparatus according to claim 12, wherein the at least part of the second feeding part is located at the second position during a feeding operation of feeding print media from the first support part.

* * * * *